US010662624B2

(12) United States Patent
Ohiwa et al.

(10) Patent No.: US 10,662,624 B2
(45) Date of Patent: May 26, 2020

(54) WORK VEHICLE AND METHOD FOR CONTROLLING WORK VEHICLE

(71) Applicant: KOMATSU LTD., Minato-ku, Tokyo (JP)

(72) Inventors: Kenji Ohiwa, Tokyo (JP); Masao Yamamura, Tokyo (JP); Tomohiro Nakagawa, Tokyo (JP)

(73) Assignee: KOMATSU LTD., Tokyo (JP)

( * ) Notice: Subject to any disclaimer, the term of this patent is extended or adjusted under 35 U.S.C. 154(b) by 3 days.

(21) Appl. No.: 15/781,802

(22) PCT Filed: Nov. 29, 2016

(86) PCT No.: PCT/JP2016/085344
§ 371 (c)(1),
(2) Date: Jun. 6, 2018

(87) PCT Pub. No.: WO2017/110379
PCT Pub. Date: Jun. 29, 2017

(65) Prior Publication Data

US 2018/0355585 A1 Dec. 13, 2018

(30) Foreign Application Priority Data

Dec. 25, 2015 (JP) ..... 2015-253701

(51) Int. Cl.
*E02F 9/26* (2006.01)

(52) U.S. Cl.
CPC ..... *E02F 9/26* (2013.01)

(58) Field of Classification Search
CPC ... G02F 9/26; G02F 9/264; G02F 3/32; G06T 7/248
USPC ..... 701/50, 34.4
See application file for complete search history.

(56) References Cited

U.S. PATENT DOCUMENTS

2005/0256607 A1 11/2005 Shepherd et al.
2013/0158786 A1* 6/2013 Fukano ..... E02F 9/264 701/34.4
2014/0100712 A1 4/2014 Nomura et al.
(Continued)

FOREIGN PATENT DOCUMENTS

CN 102251548 A 11/2011
CN 103857852 A 6/2014
CN 104884713 A 9/2015
(Continued)

*Primary Examiner* — Marthe Y Marc-Coleman
(74) *Attorney, Agent, or Firm* — Faegre Drinker Biddle & Reath LLP

(57) ABSTRACT

A work vehicle includes: a work implement having a bucket; a main body to which the work implement is attached, and having a cab; a display device provided in the cab and configured to overlay and thus display work assistance information on an actual view of a work site; a bucket teeth position calculator configured to calculate a position of teeth of the bucket of the work implement in an available display area of the display device; and a following process unit configured to display the work assistance information to follow movement of the bucket of the work implement in the available display area of the display device only at a position above the position of the teeth of the bucket of the work implement as calculated by the bucket teeth position calculator.

11 Claims, 14 Drawing Sheets

(56) References Cited

U.S. PATENT DOCUMENTS

| | | | |
|---|---|---|---|
| 2016/0193920 | A1 | 7/2016 | Tsubone et al. |
| 2019/0176812 | A1 | 6/2019 | Hirata |

FOREIGN PATENT DOCUMENTS

| | | | |
|---|---|---|---|
| JP | H01-312129 | A | 12/1989 |
| JP | 3457762 | B2 | 10/2003 |
| JP | 2007-138504 | A | 6/2007 |
| JP | 2009-243073 | A | 10/2009 |
| JP | 2014-129676 | A | 7/2014 |
| JP | 2014-148893 | A | 8/2014 |
| JP | 2016-102312 | A | 6/2016 |
| JP | 2017-210018 | A | 11/2017 |
| KR | 10-2015-0082601 | A | 7/2015 |

* cited by examiner

WORK VEHICLE AND METHOD FOR CONTROLLING WORK VEHICLE

TECHNICAL FIELD

The present invention relates to a work vehicle and a method for controlling the work vehicle, and more specifically to a work vehicle having a bucket and a method for controlling displaying an image in the work vehicle.

BACKGROUND ART

Conventionally, a work vehicle such as a hydraulic excavator has been known. Such a work vehicle has a main body and a work implement connected to the main body. For example, a work implement of a hydraulic excavator has a boom, a dipper stick, and a bucket in the stated order as seen on the side of the main body.

Japanese Patent Laying-Open No. 2009-243073 (Patent Document 1) discloses a hydraulic excavator as an example of a work vehicle. The hydraulic excavator includes a cab, a work implement, a display device, and a display position controller. The work implement is operated as manipulated by an operator in the cab. The display device is provided in the cab and displays a predetermined image.

CITATION LIST

Patent Document

PTD 1: Japanese Patent Laying-Open No. 2009-243073

SUMMARY OF INVENTION

Technical Problem

A display device provided on a front surface of a cab is a transmission-type display device and is provided so that the operator in the cab can see the work implement.

Accordingly, in order to appropriately obtain necessary information from a predetermined image displayed on the display device while efficiently manipulating the visually observed work implement, it is necessary to devise a display area for the predetermined image.

The present invention has been made in view of the above, and an object of the present invention is to provide a work vehicle which can achieve further increased working efficiency, and a method for controlling the work vehicle.

Solution to Problem

According to one aspect of the present invention, a work vehicle comprises: a work implement having a bucket; a main body to which the work implement is attached, and having a cab; a display device provided in the cab and configured to overlay and thus display work assistance information on an actual view of a work site; a bucket teeth position calculator configured to calculate a position of teeth of the bucket of the work implement in an available display area of the display device; and a following process unit configured to display the work assistance information to follow movement of the bucket of the work implement in the available display area of the display device only at a position above the position of the teeth of the bucket of the work implement as calculated by the bucket teeth position calculator.

According to the present invention, the following process unit is configured to display the work assistance information to follow movement of the bucket of the work implement in the available display area of the display device only at a position above the position of the teeth of the bucket of the work implement as calculated by the bucket teeth position calculator. An operator performing an excavating work by the bucket does not have his/her field of view obstructed by the work assistance information and can perform the excavating work further efficiently.

Preferably, the following process unit is configured to display the work assistance information to follow the movement of the bucket of the work implement in the available display area of the display device at a position above the position of the teeth of the bucket of the work implement as calculated by the bucket teeth position calculator, excluding an area allowing the bucket to move therein.

Displaying the work assistance information to follow the movement of the bucket can contribute to a reduced movement of the operator's eyes and hence further increased working efficiency.

Preferably, the work vehicle further comprises a fixing process unit configured to display the work assistance information, without following the movement of the bucket, in the available display area of the display device excluding the area allowing the bucket to move therein.

Displaying the work assistance information, without following the movement of the bucket, in an area other than the area allowing the bucket to move therein can prevent an operator performing an excavating work with the bucket from having his/her field of view obstructed by the work assistance information and thus allows the operator to efficiently perform the excavating work.

According to another aspect of the present invention, a work vehicle comprises: a work implement having a bucket; a main body to which the work implement is attached, and having a cab; a display device provided in the cab and configured to overlay and thus display work assistance information on an actual view of a work site; and a bucket teeth position calculator configured to calculate a position of teeth of the bucket of the work implement in an available display area of the display device. The display device does not display the work assistance information in an area between the position of the teeth of the bucket as calculated by the bucket teeth position calculator and a first level from the position of a lowermost end of the available display area of the display device.

Avoiding displaying the work assistance information in an area between the position of the teeth of the bucket and the first level from the lowermost end of the opening frame ensures that an operator performing an excavating work by the work implement can perform the excavating work while visually observing an area below the teeth of the bucket. The operator performing the excavating work by the bucket does not have his/her field of view obstructed by the work assistance information and can perform the excavating work further efficiently.

According to still another aspect of the present invention, a work vehicle comprises: a work implement having a bucket; a main body to which the work implement is attached, and having a cab; a display device provided in the cab and configured to be capable of transmitting external light incident on the cab and display an image; a bucket teeth position calculator configured to calculate a position of teeth of the bucket of the work implement in an available display area of the display device; and an area setter configured to set as a display area an area of the available display area of the display device between an uppermost end thereof and the position of the teeth of the bucket as calculated by the bucket teeth position calculator and an area of the available display area of the display device between a position of a lowermost end thereof and a first level from the lowermost end.

According to the present invention, the area setter sets as a display area an area of the available display area of the display device between the uppermost end thereof and the position of the teeth of the bucket as calculated by the bucket teeth position calculator and an area of the available display area of the display device between the position of the lowermost end of thereof and the first level from the lowermost end. Avoiding displaying the work assistance information in an area between the position of the teeth of the bucket and the first level from the lowermost end of the display device ensures that an operator performing an excavating work by the work implement can perform the excavating work while visually observing an area below the teeth of the bucket. The operator performing the excavating work by the bucket does not have his/her field of view obstructed by the work assistance information and can perform the excavating work further efficiently.

Preferably, the area setter determines whether the position of the teeth of the bucket of the work implement as calculated by the bucket teeth position calculator is located in the available display area of the display device at a level higher than a second level from the position of the lowermost end of the available display area of the display device, the second level being higher than the first level, and when the area setter determines that the position of the teeth of the bucket of the work implement as calculated by the bucket teeth position calculator is located in the available display area of the display device at a level higher than the second level from the position of the lowermost end of the available display area of the display device, the area setter sets as a display area an area of the available display area of the display device between the uppermost end thereof and the second level and an area of the available display area of the display device between the position of the lowermost end thereof and the first level.

When the area setter determines that the position of the teeth of the bucket of the work implement as calculated by the bucket teeth position calculator is located in the available display area of the display device at a level higher than the second level that is higher than the first level from the position of the lowermost end of the available display area of the display device, the area setter sets as a display area an area of the available display area of the display device between the uppermost end thereof and the second level and an area of the available display area of the display device between the position of the lowermost end of the display device and the first level. Providing a non-display area with a limited range can prevent a situation which reduces a display area's range and makes it difficult to display the work assistance information, and can thus contribute to further increased working efficiency.

Preferably, the work vehicle further comprises a bucket area calculator configured to calculate a ratio of the available display area of the display device occupied by the bucket of the work implement. The area setter determines whether a result of a calculation by the bucket area calculator is larger than a predetermined value. If the ratio of the available display area of the display device occupied by the bucket of the work implement is larger than the predetermined value, the area setter sets as a display area an area of the available display area of the display device between the uppermost end thereof and the position of the teeth of the bucket as calculated by the bucket teeth position calculator and an area of the available display area of the display device between the position of the lowermost end of the display device and the first level from the lowermost end. If the ratio of the available display area of the display device occupied by the bucket of the work implement is equal to or smaller than the predetermined value, the area setter sets the entirety of the available display area of the display device as a display area.

As a working condition, for an excavating work performed at a position where the teeth of the bucket is close (that is, the bucket occupies an area larger than the predetermined value), an area of the available display area of the display device between the position of the teeth of the bucket and the uppermost end of the available display area and an area of the available display area of the display device between the position of the lowermost end thereof and the first level from the lowermost end are set as a display area. Avoiding displaying the work assistance information in an area between the first level from the position of the lowermost end allows the excavating work to be done with higher precision than an excavating work performed with the bucket's teeth at a distant position, and can thus prevent the operator performing the excavating work with the bucket from having his/her field of view obstructed by the work assistance information and thus allows the operator to efficiently perform the excavating work.

Preferably, the area setter determines whether a distance between the bucket and the cab is smaller than a predetermined distance, and if the area setter determines that the distance between the bucket and the cab is smaller than the predetermined distance, the area setter sets as a display area an area of the available display area of the display device between the uppermost end thereof and the position of the teeth of the bucket as calculated by the bucket teeth position calculator and an area of the available display area of the display device between the position of the lowermost end of the display device and the first level from the lowermost end, whereas if the area setter determines that the distance between the bucket and the cab is equal to or larger than the predetermined distance, the area setter sets the entirety of the available display area of the display device as a display area.

As a working condition, for an excavating work performed at a position where the teeth of the bucket is close (that is, the bucket has a distance smaller than a predetermined distance), no work assistance information is displayed in an area between the position of the teeth of the bucket and the uppermost end of the available display area and an area of the available display area of the display device between the position of the lowermost end thereof and the first level from the lowermost end, which allows the excavating work to be done with higher precision than an excavating work performed with the bucket's teeth at a distant position, and can thus prevent the operator performing the excavating work with the bucket from having his/her field of view obstructed by the work assistance information and thus allows the operator to efficiently perform the excavating work.

Preferably, the area setter sets as a display area that area of the available display area of the display device between the uppermost end of the available display area and the position of the teeth of the bucket as calculated by the bucket teeth position calculator and an area between the position of the lowermost end of the available display area and the first level from the lowermost end, excluding an area allowing the bucket to move therein.

Avoiding displaying the work assistance information in an area of the available display area of the display device allowing the bucket to move therein can prevent an operator performing an excavating work form having his/her field of view obstructed by the work assistance information and thus allows the operator to perform the excavating work further efficiently.

Preferably, the work vehicle further comprises a following process unit configured to display the work assistance information to follow the movement of the bucket.

Displaying the work assistance information to follow the movement of the bucket can contribute to a reduced movement of the operator's eyes and hence further increased working efficiency.

According to still another aspect of the present invention, a method for controlling a work vehicle comprising: a work implement having a bucket; a main body to which the work implement is attached, and having a cab; and a display device provided in the cab and configured to overlay and thus display work assistance information on an actual view of a work site, comprises the steps of: calculating a position of teeth of the bucket of the work implement in an available display area of the display device; and displaying the work assistance information to follow movement of the bucket of the work implement in the available display area of the display device only at a position above the position of the teeth of the bucket of the work implement as calculated.

Displaying the work assistance information to follow movement of the bucket of the work implement in the available display area of the display device only at a position above the position of the teeth of the bucket of the work implement as calculated can prevent an operator performing an excavating work by the bucket from having his/her field of view obstructed by the work assistance information and thus allows the operator to perform the excavating work further efficiently.

According to still another aspect of the present invention, a method for controlling a work vehicle comprising: a work implement having a bucket; a main body to which the work implement is attached, and having a cab; a display device provided in the cab and configured to overlay and thus display work assistance information on an actual view of a work site, comprises the steps of: calculating a position of teeth of the bucket of the work implement in an available display area of the display device; and setting as a non-display area an area between the position of the teeth of the bucket of the work implement as calculated and a first level from a position of a lowermost end of the display device.

Setting as a non-display area an area located between the position of the teeth of the bucket and the first level from the lowermost end of the opening frame ensures that an operator performing an excavating work by the work implement can perform the excavating work while visually observing an area below the teeth of the bucket. The operator performing the excavating work by the bucket does not have his/her field of view obstructed by the work assistance information and can perform the excavating work further efficiently.

Advantageous Effects of Invention

The present work vehicle and method for controlling the same can achieve further increased working efficiency.

DESCRIPTION OF EMBODIMENTS

The present invention will now be described in an embodiment hereinafter with reference to the drawings. In the following description, identical components are identically denoted. Their names and functions are also identical. Accordingly, they will not be described repeatedly. In the following description, "upper," "lower," "front," "rear," "right," and "left" are terms with reference to an operator seated on an operator's seat.

A. General Configuration

Figure 1:
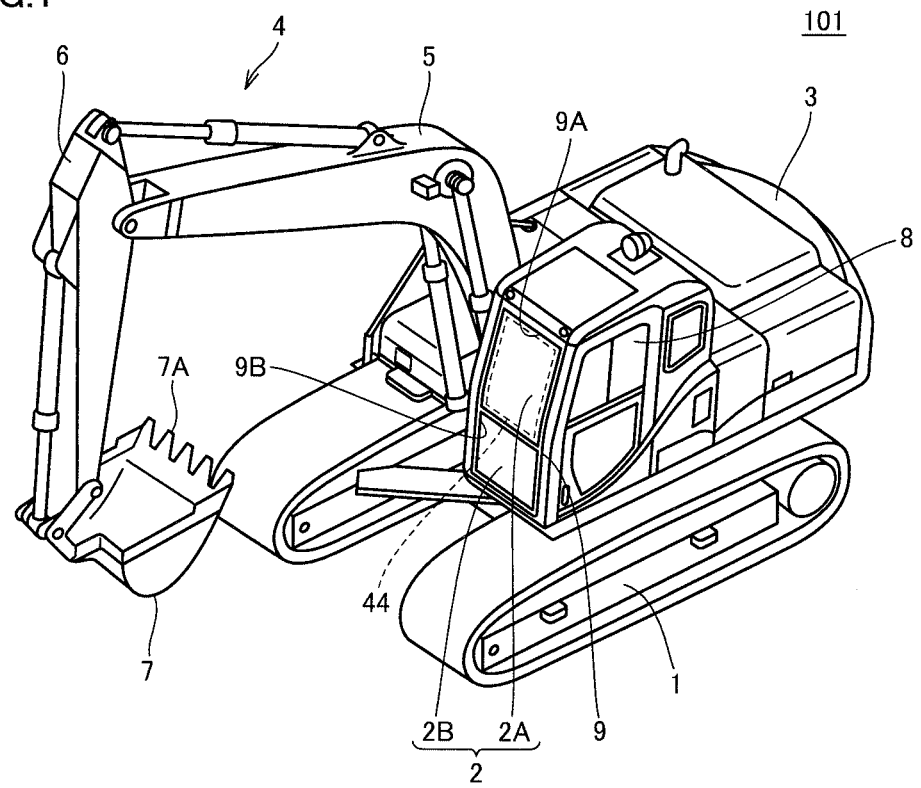
FIG. 1 is a diagram for illustrating an appearance of a work vehicle 101 according to an embodiment.

FIG. 1 is a diagram for illustrating an appearance of a work vehicle 101 according to an embodiment.

As shown in FIG. 1, a hydraulic excavator will be described as an example of work vehicle 101 according to the embodiment.

Work vehicle 101 mainly includes a travel unit 1, a revolving unit 3, and a work implement 4.

Work vehicle 101 has a main body composed of travel unit 1 and revolving unit 3. The main body has work implement 4 attached thereto. Travel unit 1 has a pair of right and left crawler belts. Revolving unit 3 is mounted via a revolving mechanism of travel unit 1 revolvably. Revolving unit 3 has a cab 8 and the like.

Work implement 4 is pivotally supported at revolving unit 3 so as to be movable upward and downward and performs a work such as excavation of soil. Work implement 4 includes a boom 5, a dipper stick 6, and a bucket 7. Work implement 4 is provided at a position visually observable on a right and front side as seen from cab 8.

Boom 5 has a base movably coupled to revolving unit 3. Dipper stick 6 is movably coupled to the distal end of boom 5. Bucket 7 is movably coupled to the distal end of dipper stick 6. Bucket 7 is movable upward and downward relative to cab 8. Further, bucket 7 is also movable frontward and rearward relative to cab 8. Bucket 7 has teeth 7A.

Cab 8 has a front windshield 2. Front windshield 2 is fixed by a frame 9. Front windshield 2 is composed of a front windshield 2A and a front windshield 2B located below front windshield 2A. Front windshield 2A is provided inside an opening frame 9A (inside an opening frame), and front windshield 2B is provided inside a lower opening frame 9B.

Display device 44 is attached in front of an operator's seat in cab 8 of work vehicle 101. In the present embodiment, display device 44 is composed of a member (a film or the like) which transmits external light incident on cab 8, and a projection device (projector). The projection device projects an image which is in turn displayed as a real image on the member (such as a film) that transmits external light. Display device 44 has a display area provided inside opening frame 9A provided on a front surface of cab 8 of work vehicle 101. The operator in cab 8 can visually observe an actual view of a work site including work implement 4 through the display area of display device 44. Display device 44 overlays on the actual view of the work site and thus display information for assisting the operator to manipulate work implement 4 (hereinafter also referred to as a work) (hereinafter also referred to as work assistance information). Display device 44 functions as a head-up display that directly displays an image in the field of view of the operator.

The member that transmits external light, such as a film, of display device 44 is placed on front windshield 2A. Display device 44 has a display extending to reach an edge of front windshield 2A. Front windshield 2A may be the same as or different from the display area of display device 44 in size.

While in the present embodiment, as display device 44, a configuration will be described in which an image projected by a projection device (projector) is displayed on a member (such as a film) that transmits external light incident on cab 8, this is not exclusive, and it is also possible to have a configuration including display device 44 which is a transparent display (for example, a transmission type liquid crystal display).

B. Configuration of Control System

Figure 2:
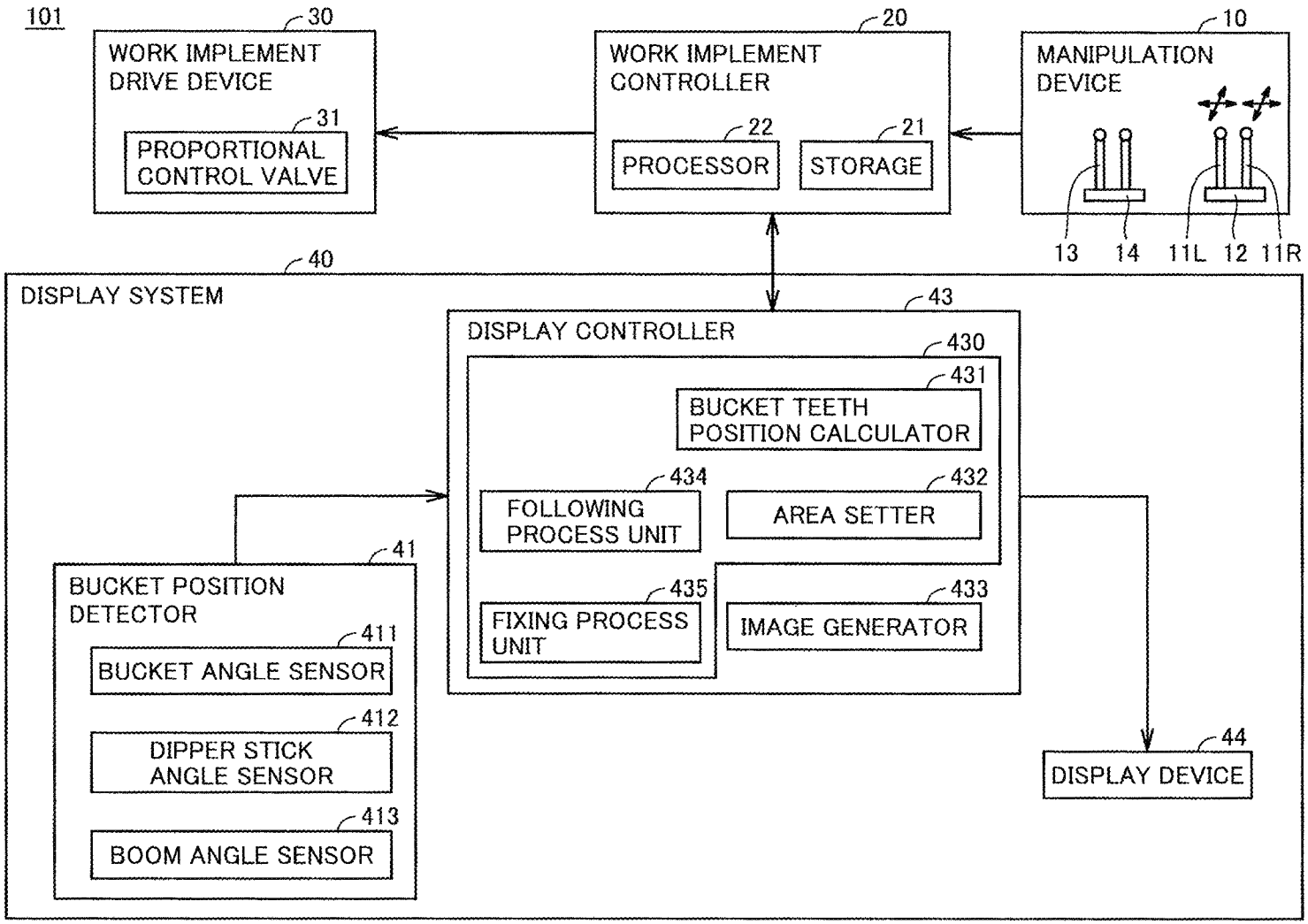
FIG. 2 is a block diagram representing a configuration of a control system included in work vehicle 101 according to an embodiment.

FIG. 2 is a block diagram representing a configuration of a control system included in work vehicle 101 according to an embodiment.

As shown in FIG. 2, work vehicle 101 includes a manipulation device 10, a work implement controller 20, a work implement drive device 30, and a display system 40.

(b1. Manipulation Device 10)

Manipulation device 10 includes manipulation members 11L and 11R, a manipulation detector 12, a travel manipulation member 13, and a travel manipulation detector 14.

Manipulation members 11L and 11R are used by the operator to manipulate work implement 4 and revolving unit 3. Manipulation member 11R is used by the operator to manipulate boom 5 and bucket 7. Manipulation member 11L is used by the operator to manipulate revolving unit 3 and dipper stick 6.

Manipulation detector 12 detects a manipulation done by the operator to manipulation member 11L. Manipulation detector 12R detects a manipulation done by the operator to manipulation member 11R.

Travel manipulation member 13 is used by the operator to control traveling of work vehicle 101. Travel manipulation detector 14 detects a pilot flow rate according to content of control done via travel manipulation member 13. Work vehicle 101 moves at a speed corresponding to the pilot flow rate.

(b2. Work Implement Controller 20)

Work implement controller 20 includes a storage 21 and a processor 22. Storage 21 is composed of memory such as RAM (Random Access Memory) and ROM (Read Only Memory). Processor 22 is composed of a processing device such as a CPU (Central Processing Unit).

Work implement controller 20 mainly controls the operation of work implement 4 and the revolution of revolving unit 3. Work implement controller 20 generates a control signal for operating work implement 4 and revolving unit 3 in response to a manipulation done to manipulation members 11L and 11R. Work implement controller 20 outputs the generated control signal to work implement drive device 30.

(b3. Work Implement Drive Device 30)

Work implement drive device 30 has a proportional control valve 31. Proportional control valve 31 operates based on a control signal issued from work implement controller 20. Proportional control valve 31 supplies a hydraulic cylinder and a revolution motor with hydraulic oil at a flow rate corresponding to the control signal. As a result, work implement 4 operates and revolving unit 3 revolves.

(b4. Display System 40)

Display device 44 of display system 40 displays various types of images such as work assistance information.

Display system 40 includes a bucket position detector 41, a display controller 43, and display device 44. In display system 40, a predetermined reference position is preset as a viewpoint position for the operator.

Bucket position detector 41 includes a bucket angle sensor 411, a dipper stick angle sensor 412, and a boom angle sensor 413.

Bucket angle sensor 411 detects a relative angle of bucket 7 from a predetermined reference position. Dipper stick angle sensor 412 detects a relative angle of dipper stick 6 from a predetermined reference position. Boom angle sensor 413 detects a relative angle of boom 5 from a predetermined reference position.

Bucket position detector 41 detects a position of bucket 7 with respect to the body of the work vehicle based on information of the three relative angles as detected. And a position of bucket 7 in the vehicular body's coordinate system is detected. Bucket position detector 41 detects the position of teeth 7A of bucket 7, for example, as the position of bucket 7.

Display controller 43 includes a display position controller 430 and an image generator 433.

Display controller 43 causes display device 44 to display the work assistance information based on the position of bucket 7 as detected.

Image generator 433 generates an image to be displayed on display device 44. Image generator 433 generates an image representing a vehicular speedometer, an engine revolution indicator, a fuel indicator, a hydraulic temperature indicator, and the like. Further, image generator 433 generates an image representing a plurality of pieces of work assistance information. A specific example of the work assistance information will be described with reference to FIG. 3 and the like.

Image generator 433 is connected to a controller (not shown) that controls a power system of work vehicle 101. Image generator 433 receives information sensed by various sensors, information of content of control done by the controller, and the like. Based on the received information, image generator 433 generates an image which display device 44 is caused to display.

Display position controller 430 computes a display position for the image with respect to the display area of display device 44 and causes display device 44 to display the image at the calculated display position. Display position controller 430 calculates a display position for work assistance information with respect to the display area of display device 44 and causes display device 44 to display the work assistance information at the calculated position.

Display position controller 430 includes a bucket teeth position calculator 431, an area setter 432, a following process unit 434, and a fixing process unit 435.

Bucket teeth position calculator 431 calculates the position of teeth 7A of bucket 7 of work implement 4 in the available display area of display device 44.

Area setter 432 sets at least a part of the available display area of display device 44 as a display area based on the position of teeth 7A of bucket 7 in the available display area of display device 44 as calculated by bucket teeth position calculator 431.

Following process unit 434 performs a process to cause display device 44 to display the work assistance information such that the information follows the movement of bucket 7.

Fixing process unit 435 performs a process to cause display device 44 to display the work assistance information without causing the information to follow the movement of bucket 7, i.e., fix and thus display the information.

Each function block of display controller 43 is implemented by a processor such as a CPU, a storage device such as RAM and ROM, and the like.

C. Method for Displaying Work Assistance Information (c1. Manner of Displaying Work Assistance Information)

Figure 3:
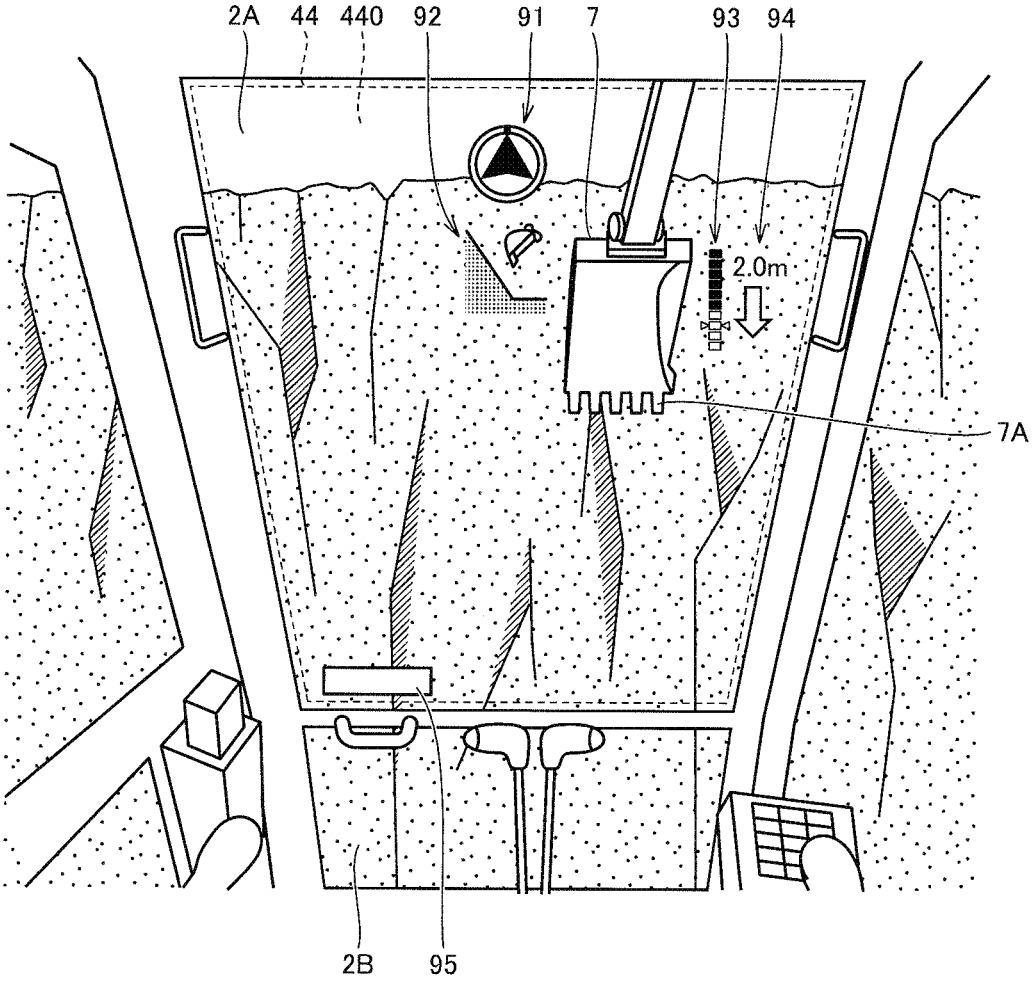
FIG. 3 is a diagram showing contents displayed by a display device 44 according to an embodiment.

FIG. 3 is a diagram showing contents displayed by display device 44 according to an embodiment.

As shown in FIG. 3, display controller 43 causes display device 44 to display a plurality of pieces of work assistance information 91 to 95 on a display area 440 of display device 44.

Display controller 43 displays the plurality of pieces of work assistance information 91 to 94 at positions where the plurality of pieces of work assistance information 91 to 94 are respectively visually observed around bucket 7. Display controller 43 displays the plurality of pieces of work assistance information 91 to 94 only at a position higher than teeth 7A of bucket 7.

In the example of FIG. 3, display controller 43 controls a display position for pieces of work assistance information 91, 92 in the display area of display device 44 such that the pieces of work assistance information 91, 92 are visually observed on a left side of bucket 7 as seen from cab 8. Further, display controller 43 controls a display position for work assistance information 93, 94 in the display area of display device 44 such that work assistance information 93, 94 is visually observed at a position on a right side of bucket 7 as seen from cab 8.

Work assistance information 91 represents a facing angle compass. The facing angle compass indicates whether work vehicle 101 is in a state in which work vehicle 101 directly faces design topography data. Furthermore, when work vehicle 101 is not in the directly facing state, the facing angle compass represents an amount of displacement by a rotation angle of an arrow indicated inside a circle. When the work vehicle is not directly facing the design topography data, display controller 43 may cause display device 44 to display work assistance information 91 in the display area of display device 44 in a manner different from that shown in FIG. 3, such as by changing a color used to display the facing angle compass.

Work assistance information 92 represents the design topography and the teeth in a cross section (a lateral cross section). Work assistance information 93 represents a bar indicator. The bar indicator is displayed when finishing excavation is performed. Graphically displaying a distance between the design topography and teeth 7A, such as the bar indicator, can enhance the operator's recognition of information. Work assistance information 94 represents a direction of the design topography, and a distance between the design topography and teeth 7A. Work assistance information 94 is displayed at the time of rough excavation and that of finishing excavation.

Work assistance information 95 is a bar showing a state of a progress of a work in the entire working process.

It should be noted that work assistance information 91 to 95 shown in FIG. 3 is one example, and the work assistance information displayed in the display area of display device 44 is not limited thereto.

(c2. Setting Display Area on Display Device 44)

Figure 4:
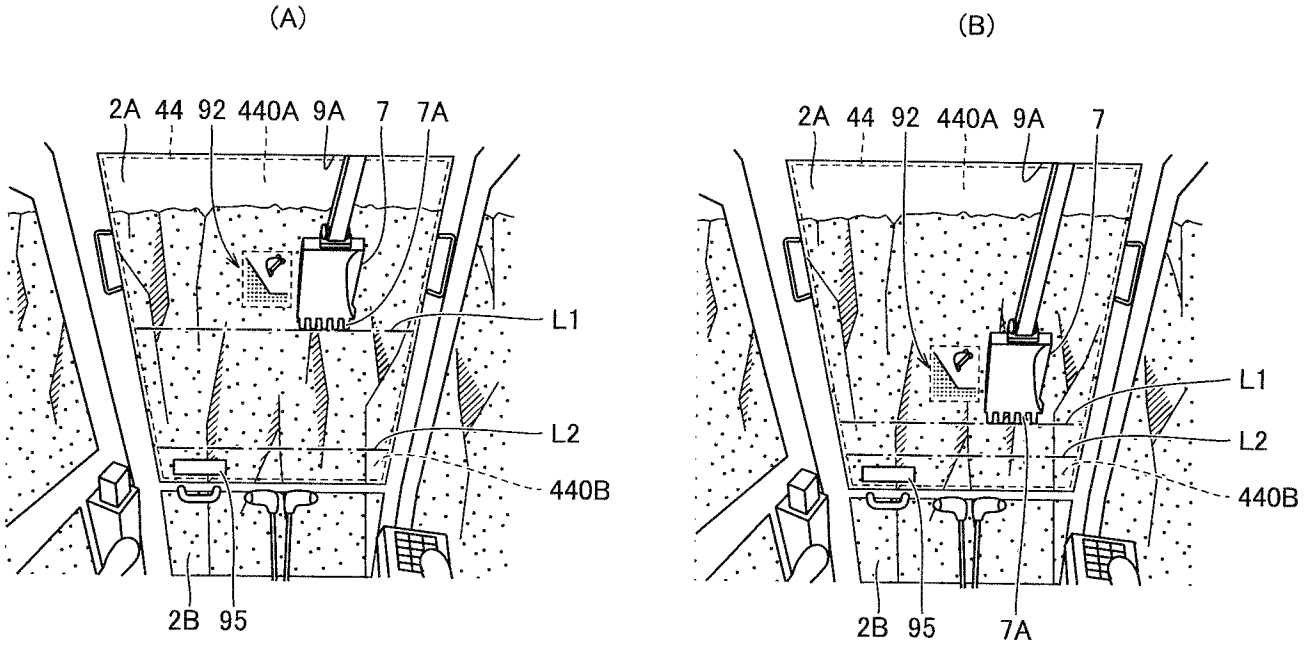
FIG. 4 is a diagram for illustrating an example of setting a display area on display device 44 according to an embodiment.

FIG. 4 is a diagram for illustrating an example of setting a display area on display device 44 according to an embodiment.

As shown in FIG. 4(A), bucket 7 is located in the vicinity of the center of the available display area of the entire plane inside opening frame 9A of display device 44. A line L1 is shown to indicate a position of teeth 7A of bucket 7 in the available display area of display device 44. Line L1 is a virtual line L1 and is not a line actually displayed. Furthermore, a line L2 is shown to indicate a predetermined level from the lowermost end of display device 44. Line L2 is a virtual line L2 and is not a line actually displayed. As an example, a case in which no line is displayed will be described, however, it is also possible to display a line. It should be noted that the predetermined level may be set to any level. It is also possible to set the predetermined level to 0 so that an area from line L1 to the lowermost end of display device 44 may entirely be set as a non-display area.

Area setter 432 sets display area 440 based on the position of teeth 7A of bucket 7. Specifically, an area of the available display area between L1 indicating teeth 7A of bucket 7 and the uppermost end of display device 44 is set as a display area 440A. An area of the available display area between line L2 indicating a predetermined level from the lowermost end of display device 44 and the lowermost end of display device 44 is set as a display area 440B. Accordingly, an area between L1 indicating teeth 7A of bucket 7 and line L2 indicating the predetermined level from the lowermost end of display device 44 will be a non-display area.

Display controller 43 exerts control to display the work assistance information in display areas 440A and 440B and avoid displaying the work assistance information in the non-display area.

Display controller 43 displays work assistance information 92 at a position above line L1 indicating the position of teeth 7A of bucket 7, i.e., in display area 440. Furthermore, display controller 43 displays work assistance information 92 on a left side of bucket 7 as seen from the operator in cab 8.

4(B) shows a case where the position of bucket 7 is changed.

Furthermore, line L1 is shown to indicate a position of teeth 7A of bucket 7 in the available display area of display device 44. Line L1 is a virtual line L1 and is not a line actually displayed. Furthermore, line L2 is shown to indicate a predetermined level from the lowermost end of display device 44. Line L2 is a virtual line L2 and is not a line actually displayed.

Area setter 432 sets a range for display area 440 based on the position of teeth 7A of bucket 7, as has been discussed above. Specifically, an area of the available display area between L1 indicating teeth 7A of bucket 7 and the uppermost end of display device 44 is set as display area 440A. Furthermore, an area of the available display area between line L2 indicating a predetermined level from the lowermost end of display device 44 and the lowermost end of display device 44 is set as display area 440B. Accordingly, an area between L1 indicating teeth 7A of bucket 7 and line L2 indicating the predetermined level from the lowermost end of display device 44 will be a non-display area.

Display controller 43 exerts control to display the work assistance information in display areas 440A and 440B and avoid displaying the work assistance information in the non-display area.

In display device 44 a process is performed to display work assistance information 92 to follow the movement of bucket 7. Specifically, when bucket 7 moves, following process unit 434 performs a process for causing a display position in the display area of display device 44 for work assistance information 92 to follow the movement of bucket 7, based on a position of the teeth of bucket 7 successively calculated by bucket teeth position calculator 431. Following process unit 434 causes the display position for work assistance information 92 to follow the movement of bucket 7 so that the information has a fixed relative positional relationship with bucket 7. By this display method, work assistance information 92 is disposed to follow bucket 7 visually observed by the operator. This can contribute to a reduced movement of the operator's eyes and hence further increased working efficiency.

Display device 44 displays work assistance information 95 at a preset position without following the movement of bucket 7. Specifically, fixing process unit 435 performs a process of displaying work assistance information 95 at the preset position.

Display device 44 provides as a non-display area an area located below line L1 indicating the position of teeth 7A of bucket 7. This ensures that an operator using manipulation members 11L and 11R to manipulate work implement 4 to perform an excavating work can do so while visually observing an area below teeth 7A of bucket 7. The operator in the excavating work by bucket 7 does not have his/her field of view obstructed by work assistance information 92 and can thus efficiently perform the excavating work. This display method allows work vehicle 101 to work further more efficiently.

While work assistance information 92 has been indicated as an example of a predetermined image following the movement of bucket 7, this is not exclusive, and a display process may be performed to cause other work assistance information 91, 93, 94 to follow the movement of bucket 7. It should be noted that displaying at least one piece of work assistance information suffices, and pieces thereof may be provided in any combination.

D. Control Flow

Figure 5:
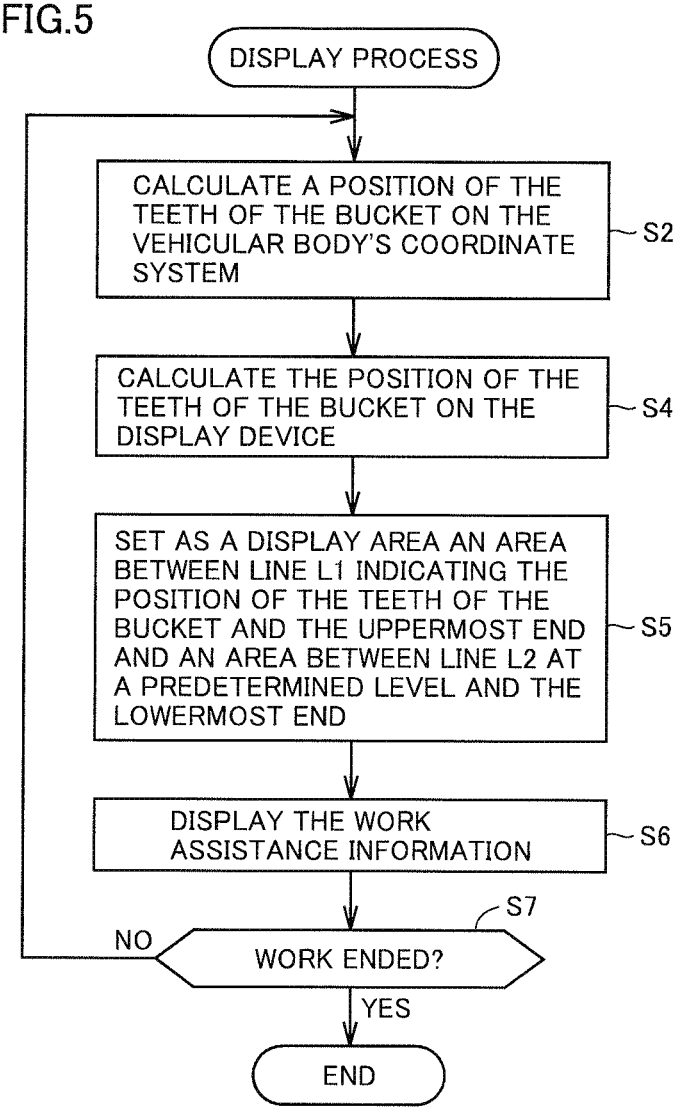
FIG. 5 is a flowchart for illustrating a process of displaying work assistance information according to an embodiment.

FIG. 5 is a flowchart for illustrating a process of displaying work assistance information according to an embodiment.

As shown in FIG. 5, display controller 43 calculates a position of teeth 7A of bucket 7 on the vehicular body's coordinate system (step S2). Specifically, bucket teeth position calculator 431 calculates the position of teeth 7A of bucket 7 on the vehicular body's coordinate system based on the position of bucket 7 on the vehicular body's coordinate system as detected by bucket position detector 41.

Subsequently, display controller 43 calculates the position of the teeth of the bucket in the available display area of display device 44 (step S4). Specifically, bucket teeth position calculator 431 calculates the position of the teeth of the bucket in the available display area of display device 44, based on the position of teeth 7A of bucket 7 on the vehicular body's coordinate system and the position of the operator's viewpoint (i.e., a reference position).

Figure 6:
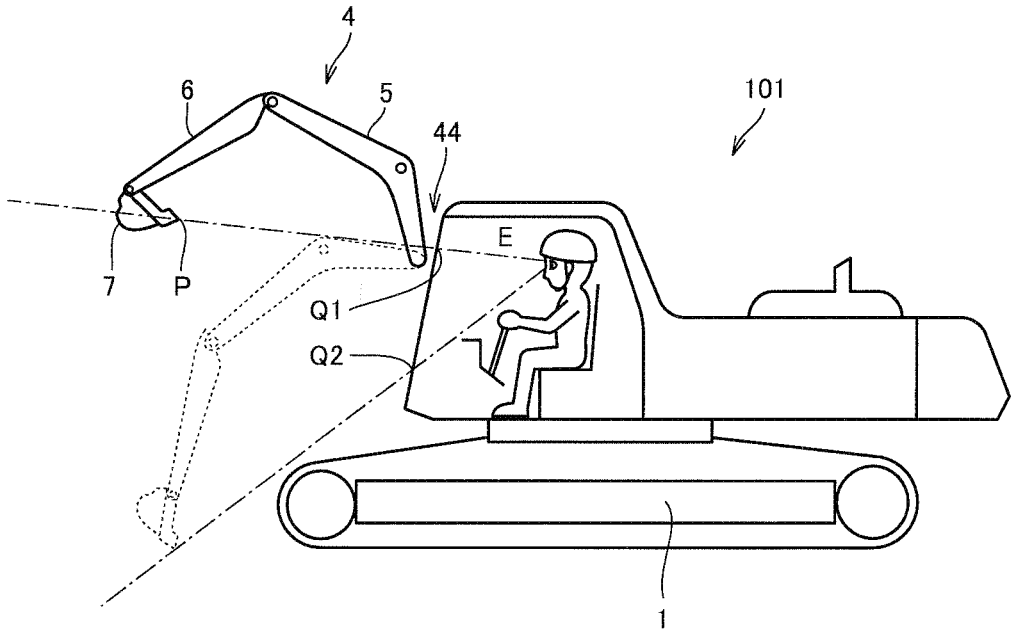
FIG. 6 is a diagram for illustrating a method for calculating the position of the teeth of a bucket 7 in an available display area of display device 44.

FIG. 6 is a diagram for illustrating a method for calculating the position of the teeth of bucket 7 in the available display area of display device 44.

FIG. 6 shows the operator's viewpoint position (or reference position) E. Bucket teeth position calculator 431 calculates a position P of teeth 7A of bucket 7 on the vehicular body's coordinate system, based on a position of bucket 7 on the vehicular body's coordinate system as detected by bucket position detector 41. Bucket teeth position calculator 431 then calculates a position at which position P of teeth 7A of bucket 7 as calculated and the operator's viewpoint position E intersect as a position Q of the teeth of bucket 7 in the available display area of display device 44. As an example, bucket teeth position calculator 431 calculates according to the position of teeth 7A of bucket 7 positions Q1 and Q2 of teeth 7A of bucket 7 in the available display area of display device 44.

Returning to FIG. 5, subsequently, display controller 43 sets as a display area an area of the available display area of display device 44 between line L1 indicating the position of the teeth of the bucket and the uppermost end of the available display area and an area of the available display area of display device 44 between line L2 at a predetermined level and the lowermost end of the available display area (step S5). Specifically, area setter 432 sets line L1 indicating a position of teeth 7A of bucket 7, as described above, based on a result of calculating position Q of the teeth calculated by bucket teeth position calculator 431. Further, area setter 432 sets line L2 indicating a predetermined level from the lowermost end of the available display area of display device 44. Area setter 432 sets as a display area an area between line L1 indicating the position of teeth 7A of bucket 7 and the uppermost end of the available display area of display device 44 and an area between the lowermost end of the available display area of display device 44 and line L2 indicating a predetermined level from the lowermost end.

Subsequently, display controller 43 displays the work assistance information in the display area set by area setter 432 (step S6). Specifically, for the work assistance information generated by image generator 433, following process unit 434 performs a display process to follow the movement of bucket 7. As one example, when bucket 7 moves, following process unit 434 performs a process for causing a display position in the display area of display device 44 for work assistance information 92 to follow the movement of bucket 7, based on a position of the teeth of bucket 7 successively calculated by bucket teeth position calculator 431. Furthermore, fixing process unit 435 performs a process of displaying work assistance information 95 at a preset position.

Subsequently, display controller 43 determines whether the work has ended (step S7).

In step S7, if display controller 43 determines that the work has ended (YES in step S7), display controller 43 ends the display process (END). For example, it is determined that the work has ended when it is detected that the operator has performed an operation to stop the engine.

On the other hand, if it is determined in step S7 that the work has not ended (NO in step S7), display controller 43 returns to step S2 and repeats the above process.

E. Modification e1. First Modification

Figure 7:
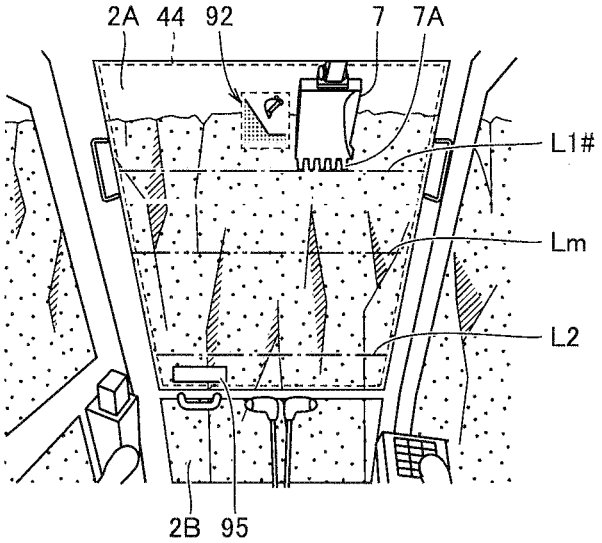
FIG. 7 is a diagram for illustrating setting a display area on display device 44 according to a first modification of an embodiment.

FIG. 7 is a diagram for illustrating setting a display area on display device 44 according to a first modification of an embodiment.

As shown in FIG. 7, a case where bucket 7 has moved upward is shown.

As an example, a line L1# is shown to indicate a position of teeth 7A of bucket 7. Further, line L2 is shown to indicate a predetermined level in the available display area of display device 44 from the lowermost end thereof. Further, a line Lm is shown in the available display area of display device 44 at an intermediate position between the uppermost end and the lowermost end.

In the first modification, a case where a non-display area has a limited range will be described.

As an example, line Lm is set as a threshold line. While threshold line Lm can be set to any value, it may be set in the available display area of display device 44 to be lower than the intermediate position between the uppermost end and the lowermost end.

When line L1# indicating a position of teeth 7A of bucket 7 is higher than threshold line Lm, area setter 432 sets as a display area an area of the available display area of display device 44 between line Lm and the uppermost end of the available display area and an area of the available display area of display device 44 between line L2 indicating the predetermined level and the lowermost end of the available display area. Accordingly, an area between line Lm and line L2 will be a non-display area.

When line L1# indicating the position of teeth 7A of bucket 7 is located at or below threshold line Lm, area setter 432 sets as a display area an area of the available display area of display device 44 between line L1# and the uppermost end of the available display area and an area of the available display area of display device 44 between line L2 indicating the predetermined level and the lowermost end of the available display area. Accordingly, an area between line L1# and line L2 will be a non-display area.

In the first modification, display device 44 has an available display area with a non-display area having a limited range.

By this method, display device 44 can be prevent from having an excessively small display area and a situation can be avoided in which it is difficult to display the work assistance information. This display method allows work vehicle 101 to work further more efficiently.

Figure 8:
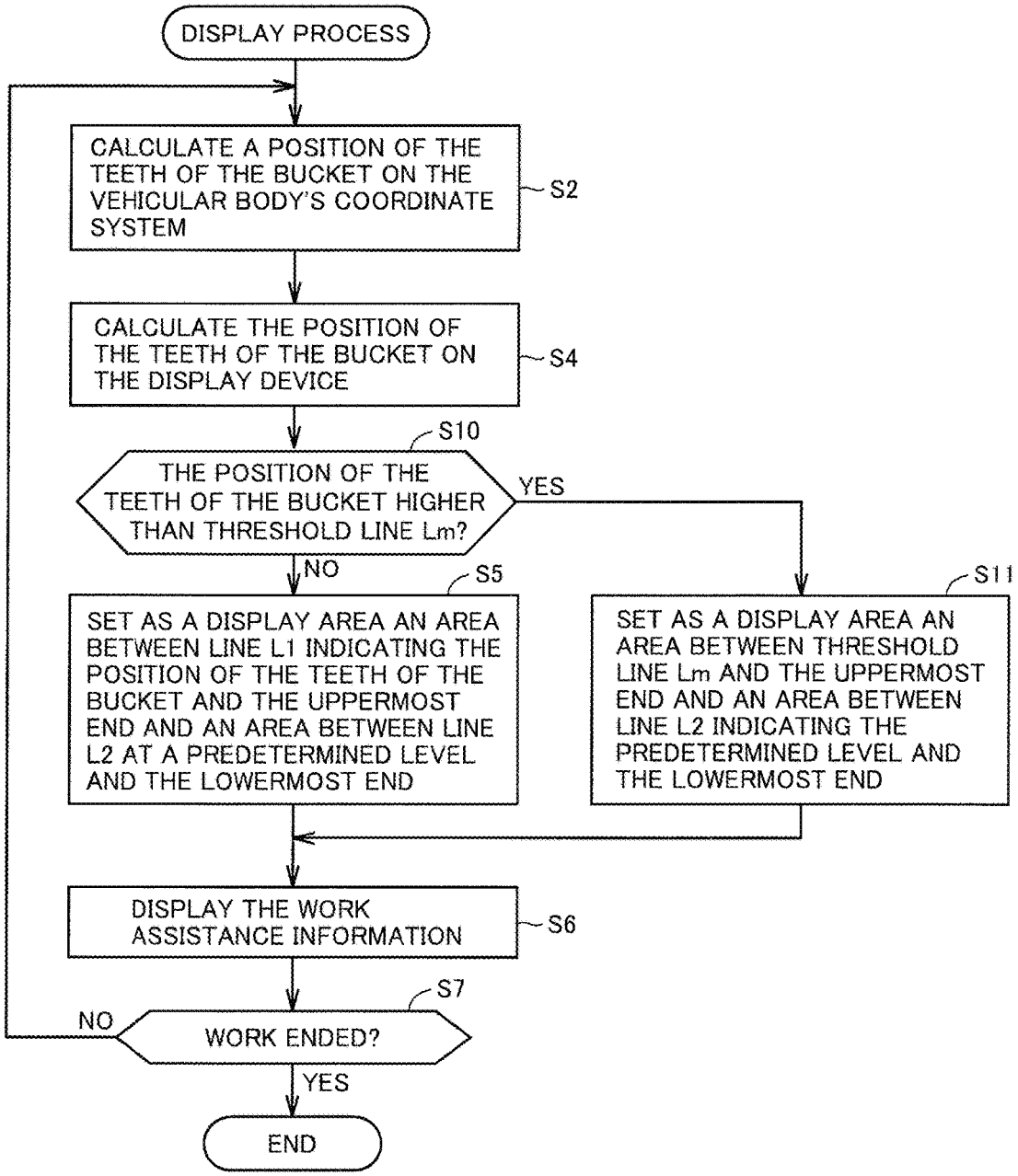
FIG. 8 is a flowchart for illustrating a process of displaying work assistance information according to the first modification of the embodiment.

FIG. 8 is a flowchart for illustrating a process of displaying work assistance information according to the first modification of the embodiment.

The FIG. 8 flowchart differs from the FIG. 5 flowchart in that in the former, steps S10 and S11 are added. The remainder in configuration is similar, and accordingly, it will not be described repeatedly in detail.

After a position of the teeth of the bucket in the available display area of display device 44 is calculated, display controller 43 determines whether the position of the teeth of the bucket is higher than threshold line Lm (step S10). Specifically, based on a result of calculating position Q of the teeth by bucket teeth position calculator 431, area setter 432 determines whether line L1# indicating the position of teeth 7A of bucket 7, as described above, is higher than line Lm serving as a predetermined threshold value.

In step S10, when display controller 43 determines that the position of the teeth of the bucket is higher than threshold line Lm (YES in step S10), display controller 43 sets as a display area an area of the available display area of display device 44 between threshold line Lm and the uppermost end of the available display area and an area of the available display area of display device 44 between line L2 indicating the predetermined level and the lowermost end of the available display area (step S11). Accordingly, in this case, an area between line Lm and line L2 will be a non-display area.

The control proceeds to step S6.

In contrast, in step S10, when display controller 43 determines that the position of the teeth of the bucket is not higher than threshold line Lm (NO in step S10), display controller 43 sets as a display area an area of the available display area of display device 44 between line L1# indicating the position of the teeth of the bucket and the uppermost end of the available display area and an area of the available display area of display device 44 between line L2 indicating the predetermined level and the lowermost end of the available display area (step S5). Accordingly, in this case, an area between line L1# and line L2 will be a non-display area. Subsequently, the control proceeds to step S6.

Step S6 et seq. are similar to those described with reference to FIG. 5, and accordingly, will not be described repeatedly in detail.

This method allows display device 44 to have a non-display area with a maximum range limited to the range of the area between line Lm and line L2.

While in this example is described a method in which at step S10 whether the position of the teeth of the bucket is higher than threshold line Lm is determined, the method is one example, and for example, it is possible to change the method to a method in which display controller 43 determines whether the position of the teeth of the bucket is not lower than threshold line Lm. In addition, in this regard, it is also possible to adopt a method in which whether the position of the teeth of the bucket is at the same position as threshold line Lm and whether the position of the teeth of the bucket is higher than threshold line Lm are determined as different processes.

e2. Second Modification

Figure 9:
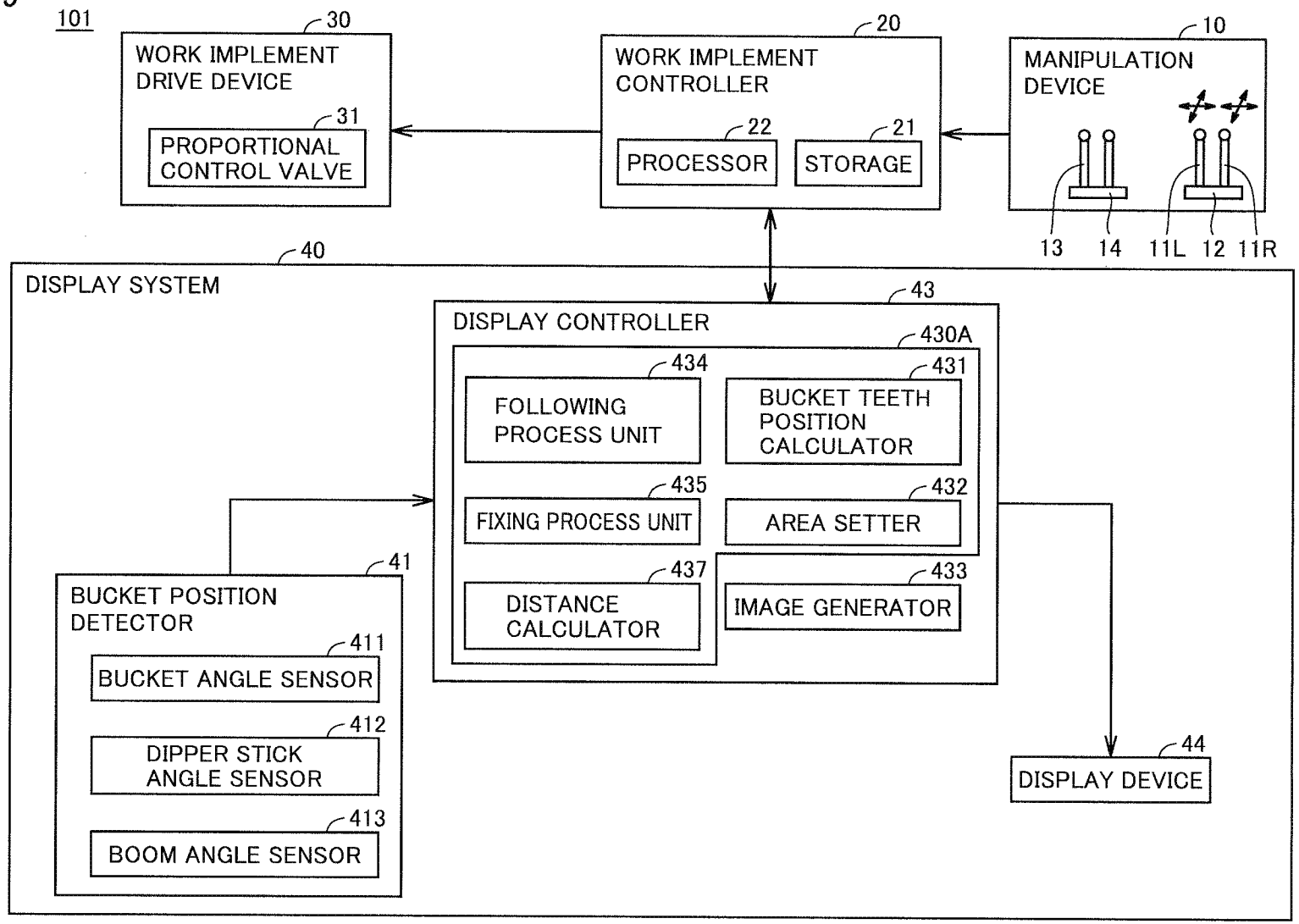
FIG. 9 is a block diagram representing a configuration of a control system included in work vehicle 101 according to a second modification of an embodiment.

FIG. 9 is a block diagram representing a configuration of a control system included in work vehicle 101 according to a second modification of an embodiment.

The FIG. 9 configuration differs from the FIG. 2 configuration in that display position controller 430 is replaced with a display position controller 430A. The remainder in configuration is similar, and accordingly, it will not be described repeatedly in detail.

Display position controller 430A is different from display position controller 430 in that a distance calculator 437 is added. The remainder in configuration is similar, and accordingly, it will not be described repeatedly in detail.

Distance calculator 437 computes a distance between bucket 7 and the vehicular body (for example, cab 8) of work vehicle 101. Distance calculator 437 outputs a computation result to area setter 432.

Figure 10:
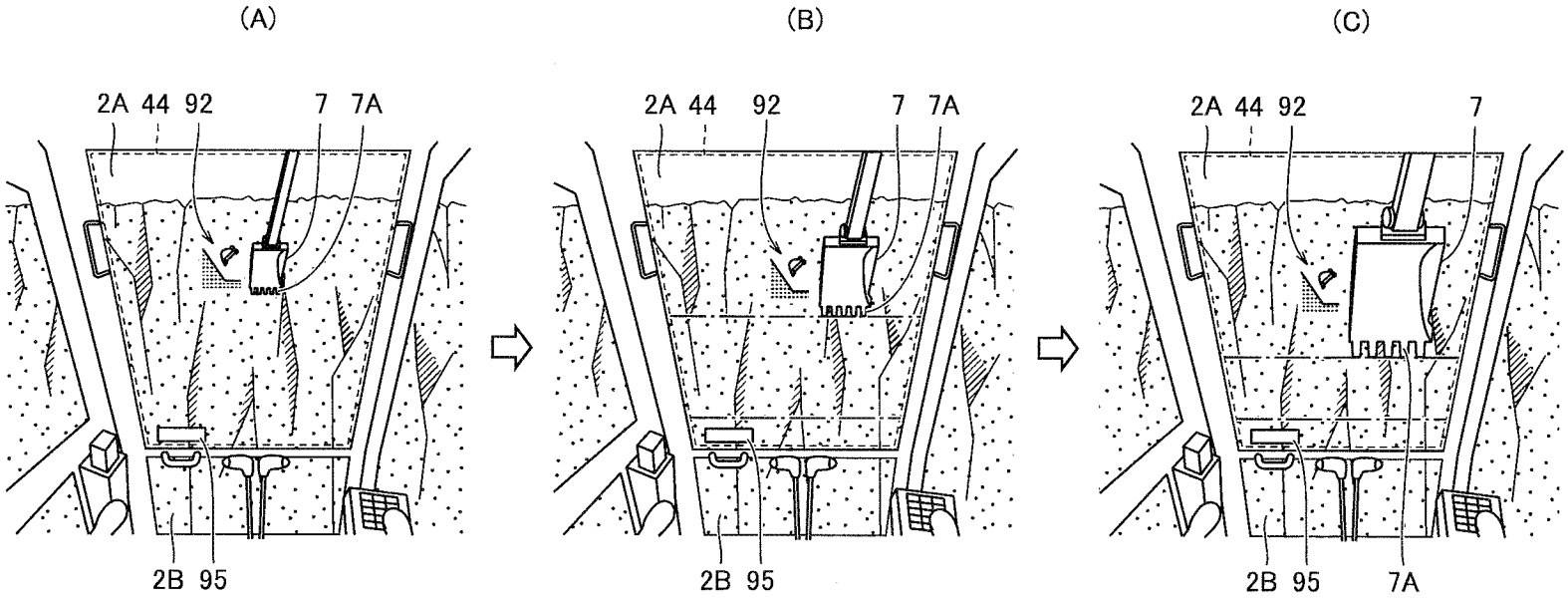
FIG. 10 is a diagram for illustrating setting a display area on display device 44 according to the second modification of the embodiment.

FIG. 10 is a diagram for illustrating setting a display area on display device 44 according to the second modification of the embodiment.

As shown in FIGS. 10(A) to 10(C), there is shown a case where bucket 7 varies in size in the available display area of display device 44 as the operator manipulates work implement 4. Specifically, there is shown a case where bucket 7 positionally varies with respect to and gradually approaches the vehicular body of work vehicle 101. There is shown a case where in the case of FIG. 10(A) there is a large distance between bucket 7 and the body of work vehicle 101 and in the case of FIG. 10(C) there is a small distance between bucket 7 and the body of work vehicle 101.

In the case of FIG. 10(A), as an example, as there is a large distance between bucket 7 and work vehicle 101, a display area with no limitation applied is provided. In this case, display device 44 has its available display area entirely used as a display area. In the cases of FIGS. 10(B) and 10(C), as there is a smaller distance between bucket 7 and work vehicle 101 than a predetermined distance, and accordingly, the display area is limited. Specifically, area setter 432 sets a display area, as has been discussed above. By setting the display area, an area other than that will be a non-display area.

By this method, when a distance between bucket 7 and the vehicular body of work vehicle 101 is smaller than the predetermined distance, a display area is limited and an area below teeth 7A of bucket 7 will be a non-display area.

As a working condition, an excavating work performed at a position with teeth 7A of bucket 7 having a small distance to the vehicular body of work vehicle 101 needs to be more precise than an excavating work performed at a position with teeth 7A of bucket 7 being distant from the vehicular body of work vehicle 101, and the method ensures that the operator can perform the excavating work while visually observing an area below teeth 7A of bucket 7. The operator in the excavating work by bucket 7 does not have his/her field of view obstructed by work assistance information or the like and can thus efficiently perform the excavating work. This display method allows work vehicle 101 to work further more efficiently.

Figure 11:
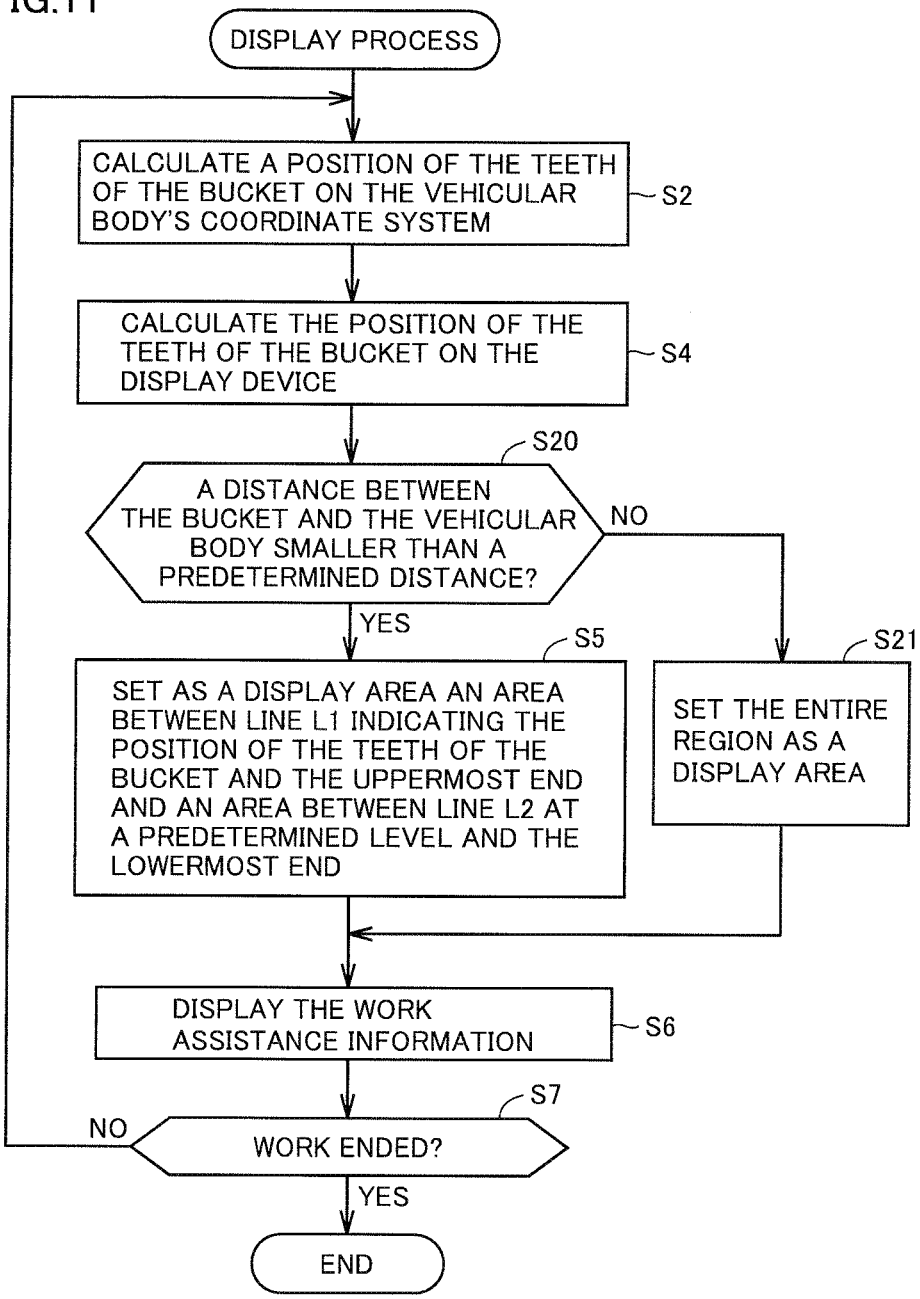
FIG. 11 is a flowchart for illustrating a process of displaying work assistance information according to the second modification of the embodiment.

FIG. 11 is a flowchart for illustrating a process of displaying work assistance information according to the second modification of the embodiment.

The FIG. 11 flowchart differs from the FIG. 5 flowchart in that in the former, steps S20 and S21 are added. The remainder in configuration is similar, and accordingly, it will not be described repeatedly in detail.

After a position of the teeth of the bucket in the available display area of display device 44 is calculated, display controller 43 determines whether a distance between the bucket and the vehicular body is smaller than a predetermined distance (step S20). Specifically, area setter 432 determines whether the distance is smaller than the predetermined distance based on a result of calculating (the distance between the bucket and the vehicular body) by distance calculator 437. It should be noted that the predetermined value may be set to any value.

In step S20, when display controller 43 determines that the distance between the bucket and the vehicular body is smaller than the predetermined distance (YES in step S20), display controller 43 sets as a display area an area of the available display area of display device 44 between line L1 indicating the position of the teeth of bucket 7 and the uppermost end of the available display area and an area of the available display area of display device 44 between line L2 indicating the predetermined level and the lowermost end of the available display area (step S5). More specifically, area setter 432 sets as a display area an area between line L1 indicating the position of teeth 7A of bucket 7 based on a result of calculating position Q of the teeth by bucket teeth position calculator 431 and the uppermost end of the available display area of display device 44 and an area between the lowermost end of the available display area of display device 44 and line L2 indicating the predetermined level from the lowermost end. Subsequently, the control proceeds to step S6. Accordingly, an area between line L1 and line L2 will be a non-display area.

In step S20, when display controller 43 determines that the distance between the bucket and the vehicular body is not smaller than the predetermined distance (NO in step S20), display controller 43 sets the entirety of the available display area of display device 44 as a display area (step S21). Specifically, area setter 432 sets as the display area the area of the entire plane inside opening frame 9A of display device 44. Subsequently, the control proceeds to step S6. Step S6 et seq. are similar to those described with reference to FIG. 5, and accordingly, will not be described repeatedly in detail.

While in this example is described a method in which at step S20 whether a distance between the bucket and the vehicular body is smaller than a predetermined distance is determined, the method is one example, and for example, it is possible to change the method to a method in which display controller 43 determines whether a distance between the bucket and the vehicular body is not larger than the predetermined distance. In addition, in this regard, it is also possible to adopt a method in which whether the distance between the bucket and the vehicular body is the predetermined distance and whether the distance between the bucket and the vehicular body is smaller than the predetermined distance are determined as different processes.

e3. Third Modification

Figure 12:
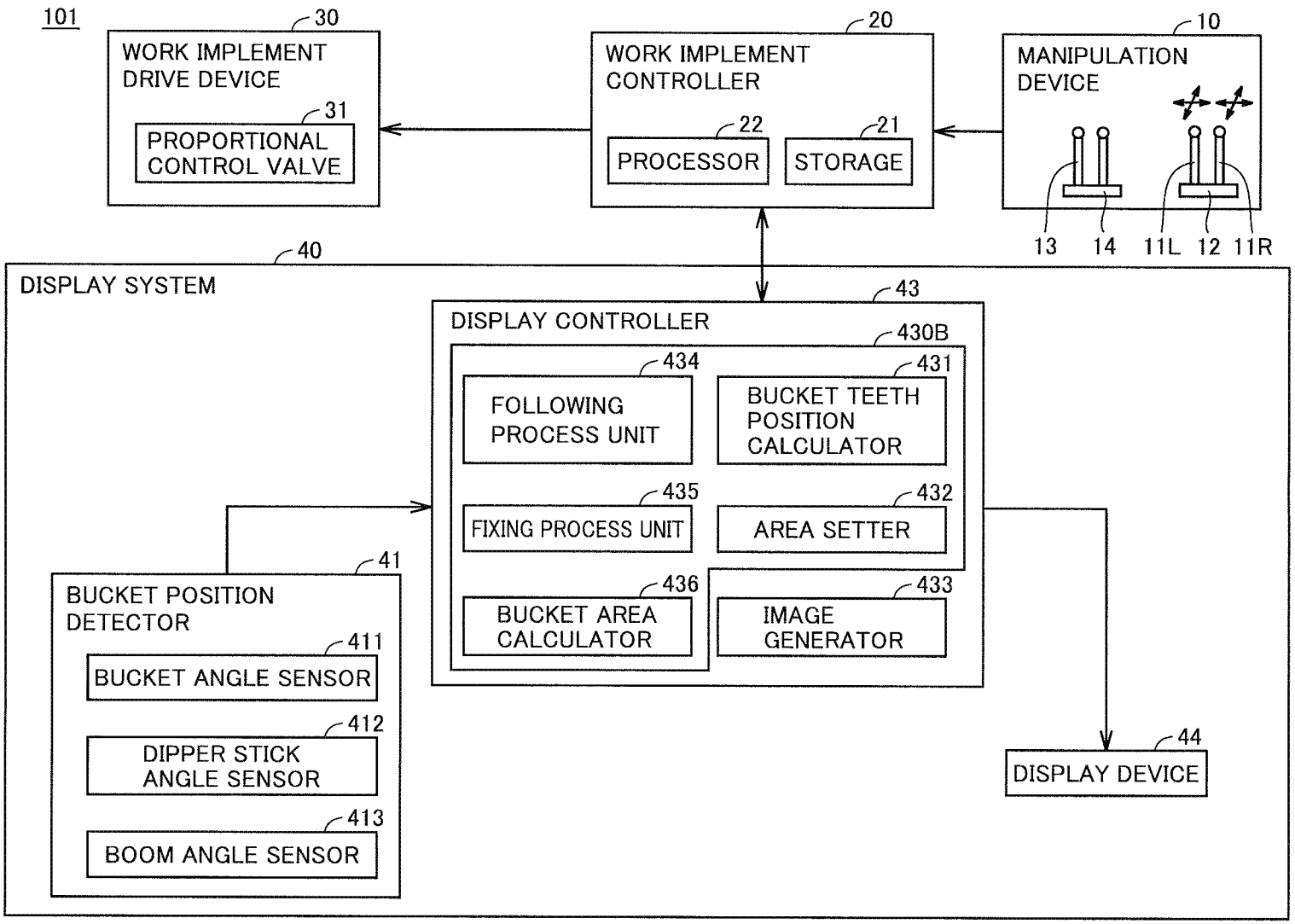
FIG. 12 is a block diagram representing a configuration of a control system included in work vehicle 101 according to a third modification of an embodiment.

FIG. 12 is a block diagram representing a configuration of a control system included in work vehicle 101 according to a third modification of an embodiment.

The FIG. 12 configuration differs from the FIG. 2 configuration in that display position controller 430 is replaced with a display position controller 430B. The remainder in configuration is similar, and accordingly, it will not be described repeatedly in detail.

Display position controller 430B is different from display position controller 430 in that a bucket area calculator 436 is added. The remainder in configuration is similar, and accordingly, it will not be described repeatedly in detail.

Bucket area calculator 436 calculates an area of bucket 7 in the available display area of display device 44. Bucket area calculator 436 outputs a computation result to area setter 432.

As in an example described with reference to FIG. 10, as an operator manipulates work implement 4 and accordingly, bucket 7 and the vehicular body of work vehicle 101 have a reduced distance therebetween, bucket 7 varies in size in the available display area of display device 44. More specifically, in the case of FIG. 10(A), bucket 7 and the vehicular body of work vehicle 101 have a large distance therebetween and bucket 7 occupies a small area in the available display area of display device 44. In the case of FIG. 10(C), bucket 7 and the vehicular body of work vehicle 101 have a small distance therebetween and bucket 7 occupies a large area in the available display area of display device 44.

In the third modification, a display area is limited when bucket 7 occupies in the available display area of display device 44 an area equal to or larger than a predetermined value.

As a working condition, an excavating work performed at a position where teeth 7A of bucket 7 is close (that is, bucket 7 occupies an area larger than the predetermined value) needs to be more precise than an excavating work performed at a position where teeth 7A of bucket 7 is distant, and the method ensures that the operator can perform the excavating work while visually observing an area below teeth 7A of bucket 7. The operator in the excavating work by bucket 7 does not have his/her field of view obstructed by work assistance information or the like and can thus efficiently perform the excavating work. This display method allows work vehicle 101 to work further more efficiently.

Figure 13:
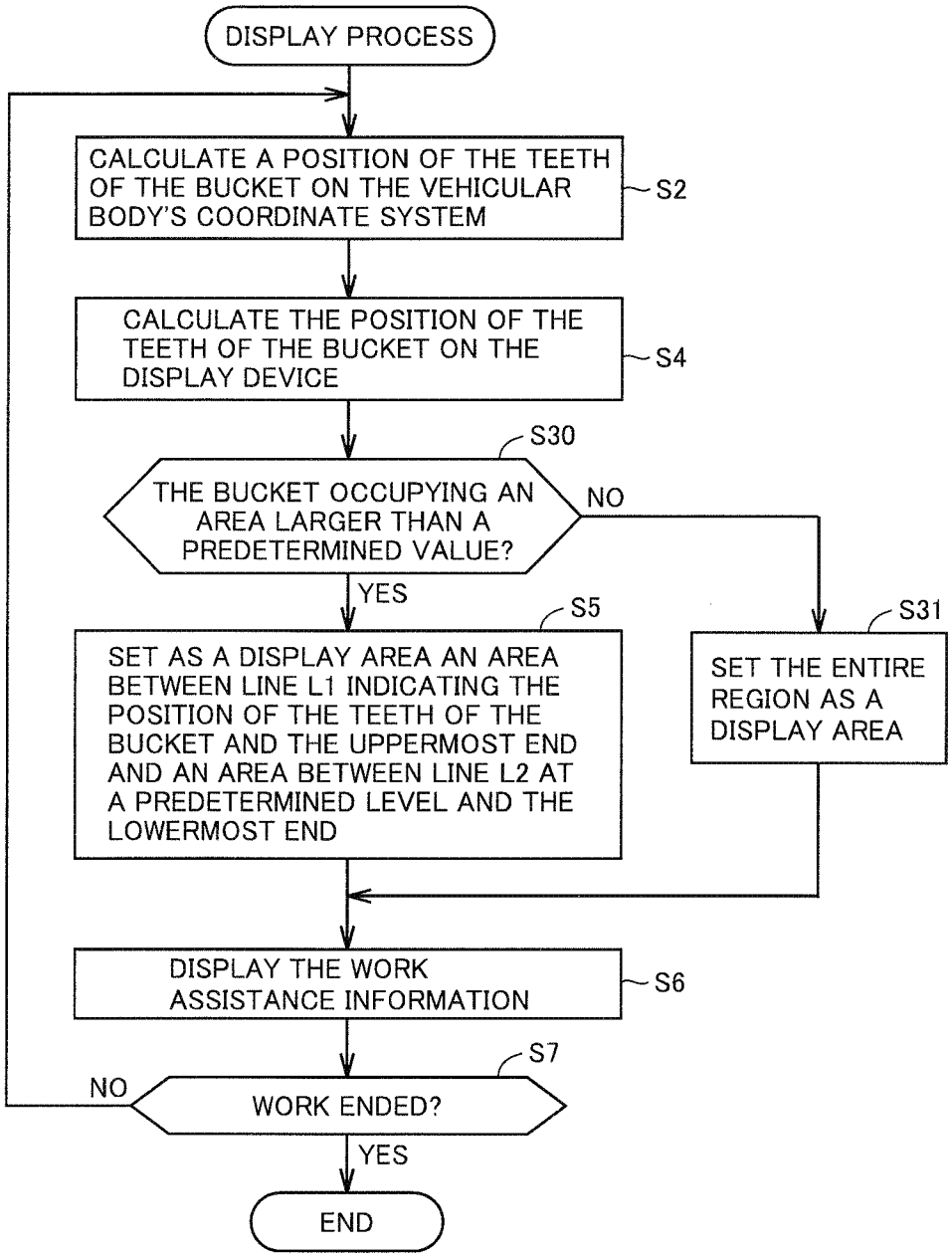
FIG. 13 is a flowchart for illustrating a process of displaying work assistance information according to the third modification of the embodiment.

FIG. 13 is a flowchart for illustrating a process of displaying work assistance information according to the third modification of the embodiment.

The FIG. 13 flowchart differs from the FIG. 5 flowchart in that in the former, steps S30 and S31 are added. The remainder in configuration is similar, and accordingly, it will not be described repeatedly in detail.

After a position of the teeth of the bucket in the available display area of display device 44 is calculated, display controller 43 determines whether the bucket occupies an area larger than a predetermined value (step S30). Specifically, area setter 432 determines whether the area is larger than the predetermined value based on a result of computing (an area of bucket 7 in the available display area of display device 44) by bucket area calculator 436. It should be noted that the predetermined value may be set to any value.

In step S30, when display controller 43 determines that the bucket occupies an area larger than the predetermined value (YES in step S30), display controller 43 sets as a display area an area of the available display area of display device 44 between line L1 indicating the position of the teeth of bucket 7 and the uppermost end of the available display area and an area of the available display area of display device 44 between line L2 indicating the predetermined level and the lowermost end of the available display area (step S5). More specifically, area setter 432 sets as a display area an area between line L1 indicating the position of teeth 7A of bucket 7 based on a result of calculating position Q of the teeth as calculated by bucket teeth position calculator 431 and the uppermost end of the available display area of display device 44 and an area between the lowermost end of the available display area of display device 44 and line L2 indicating the predetermined level from the lowermost end. Subsequently, the control proceeds to step S6. Accordingly, an area between line L1 and line L2 will be a non-display area.

In step S30, when display controller 43 determines that the bucket occupies an area equal to or smaller than the predetermined value (NO in step S30), display controller 43 sets the entirety of the available display area of display device 44 as a display area (step S31). Specifically, area setter 432 sets as the display area the area of the entire plane inside opening frame 9A of display device 44. Subsequently, the control proceeds to step S6. Step S6 et seq. are similar to those described with reference to FIG. 5, and accordingly, will not be described repeatedly in detail.

While in this example a method has been described in which at step S30 whether the bucket occupies an area larger than a predetermined value is determined, the method is one example and for example it is possible to change the method to a method in which display controller 43 determines whether the bucket occupies an area equal to or larger than the predetermined value. In addition, in this regard, it is also possible to adopt a method in which whether the bucket's area has the predetermined value and whether the bucket's area is larger than the predetermined value are determined as different processes.

e4. Fourth Modification

As has been described above, work implement 4 is provided at a position visually observed in a rightward and frontward direction as seen from cab 8. Specifically, boom 5 has its base on a lateral side of cab 8. This limits an area of the available display area of display device 44 of cab 8 that allows bucket 7 of work implement 4 to move therein.

Figure 14:
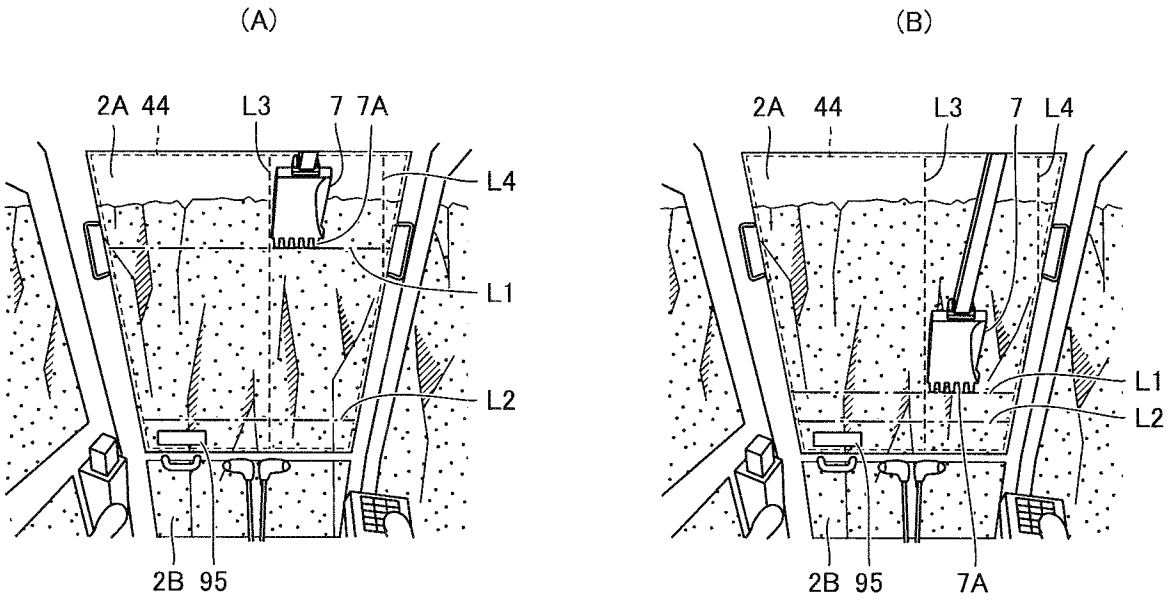
FIG. 14 is a diagram for illustrating an example of an area on display device 44 allowing bucket 7 to move therein according to a fourth modification of an embodiment.

FIG. 14 is a diagram for illustrating an example of an area on display device 44 allowing bucket 7 to move therein according to a fourth modification of an embodiment.

As shown in FIGS. 14(A) and 14(B), as an example, an area of the available display area of display device 44 allowing bucket 7 to move therein is shown. Specifically, an area surrounded by line L1 and lines L3 and L4 orthogonal to line L1 is set as an area allowing bucket 7 to move therein. Lines L3 and L4 are lines defined according to a possible position that teeth 7A of bucket 7 assume in the available display area of display device 44 as bucket 7 is manipulated with manipulation members 11L and 11R.

Area setter 432 in the fourth modification sets as a display area an area of the available display area of display device 44 other than an area allowing bucket 7 to move therein. Area setter 432 sets as the display area that area of the available display area of display device 44 between line L1 indicating the position of teeth 7A of bucket 7 and the uppermost end of display device 44 and an area between line L2 indicating the predetermined level from the lowermost end and the lowermost end of display device 44, excluding the area allowing bucket 7 to move therein. Accordingly, an area surrounded by line L1 indicating the position of teeth 7A of bucket 7 and line L2 indicating the predetermined level from the lowermost end will be a non-display area. Furthermore, a movement allowing area surrounded by line L3 and line L4 will be a non-display area.

By this method, an area allowing bucket 7 to move therein will be a non-display area. The operator in an excavating work by bucket 7 does not have his/her field of view obstructed by work assistance information and can thus efficiently perform the excavating work.

e5. Fifth Modification

Work vehicle 101 may include a display device having a configuration different from that of display device 44. Specifically, work vehicle 101 may include a combiner as a display device.

Figure 15:
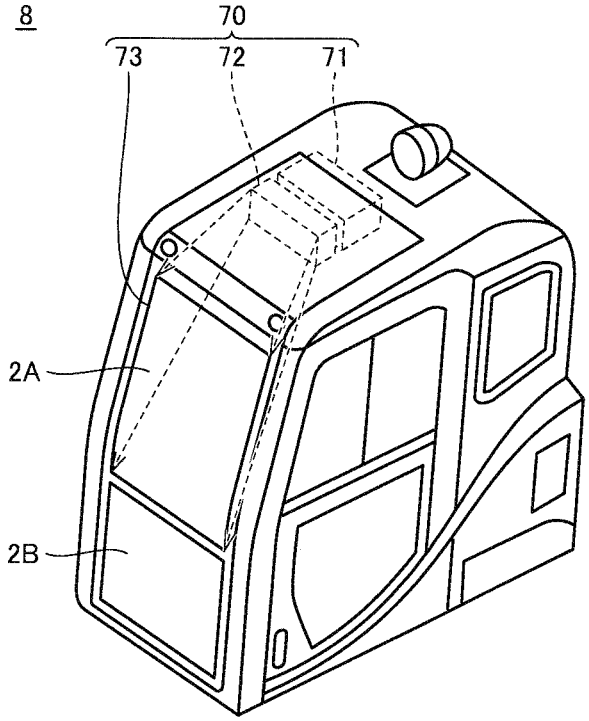
FIG. 15 is a diagram showing another display device having a configuration different from that of display device 44 according to an embodiment.

FIG. 15 is a diagram showing another display device having a configuration different from that of display device 44 according to an embodiment.

As shown in FIG. 15, a display device 70 is provided in cab 8, and has a projection device 71, an optical lens system 72, and a combiner 73.

Projection device 71 is a projector. Optical lens system 72 is disposed between projection device 71 and combiner 73. Optical lens system 72 has a plurality of lenses. Optical lens system 72 has the plurality of lenses with some thereof movable along the optical axis.

Combiner 73 is disposed at front windshield 2A. Combiner 73 may be disposed at front windshield 2A and front windshield 2B. Combiner 73 is composed of a half mirror which reflects a part of light and transmits a remainder thereof. Combiner 73 reflects an image projected by projection device 71 to the side of the operator in cab 8 and transmits light from the outside of cab 8 to the interior of cab 8.

Thus, display device 70 allows the operator to recognize the image projected on combiner 73 as a virtual image overlaid and thus displayed on an actual view in front of cab 8.

Thus a work vehicle comprising display device 70 using combiner 73 can also achieve an effect similar to that of work vehicle 101 of an embodiment.

e6. Sixth Modification

While in the above description a configuration in which display device 44 displays in a display area inside opening frame 9A has been described as an example, the present invention is not limited thereto. Display device 44 may also display an inside of opening frame 9B as a display area. That is, cab 8 may be configured to include a transparent dual display. In that case, display controller 43 will control displaying in two display areas. It is also possible to provide another display device for the display area of opening frame 9B.

A work vehicle having such a configuration can also achieve an effect similar to that obtained by work vehicle 101 described above. Note that in the above case, the work assistance information can also be displayed in a display area of the lower display device. When bucket 7 moves in a downward direction, display controller 43 can cause the work assistance information to follow bucket 7 to a position lower than in the case shown in FIG. 4 and the like.

While a hydraulic excavator has been described as an example of a work vehicle, the work vehicle is also applicable to a backhoe loader and other work vehicles.

e7. Seventh Modification

While in the above configuration a case has been described in which area setter 432 sets a range for display area 440 based on a position of teeth 7A of bucket 7, as has been described above, area setter 432 may not set a range for a display area and may instead set a range for a non-display area. Display controller 43 exerts control to avoid displaying the work assistance information in the non-display area thus set. Specifically, display controller 43 displays the work assistance information in a display area other than the set non-display area. This method also allows a process similar to that described above to be implemented.

It should be understood that the embodiments disclosed herein are illustrative and not limited to the above disclosure. The scope of the present invention is defined by the terms of the claims, and is intended to include any modifications within the meaning and scope equivalent to the terms of the claims.

REFERENCE SIGNS LIST

1: travel unit; 2: front windshield; 2A: front windshield; 2B: front windshield; 3: revolving unit; 4: work implement; 5: boom; 6: dipper stick; 7: bucket; 7A: teeth; 8: cab; 9: frame; 9A, 9B: opening frame; 10: manipulation device; 11L, 11R: manipulation member; 12: manipulation detector; 13: travel manipulation member; 14: travel manipulation detector; 20: work implement controller; 21: storage; 22: processor; 30: work implement drive device; 31: proportional control valve; 40: display system; 41: bucket position detector; 43: display controller; 44, 70: display device; 71: projection device; 72: optical lens system; 73: combiner; 91, 92, 93, 94, 95: work assistance information; 101: work vehicle; 411: bucket angle sensor; 412: dipper stick angle sensor; 413: boom angle sensor; 422: seat position sensor; 430, 430A, 430B: display position controller; 431: bucket teeth position calculator; 432: area setter; 433: image generator; 434: following process unit; 435: fixing process unit; 436: bucket area calculator; 437: distance calculator.

The invention claimed is:

1. A work vehicle comprising:

a work implement having a bucket;

a main body to which the work implement is attached, and having a cab;

a display device provided in the cab and configured to overlay and display work assistance information on an actual view of a work site;

a bucket teeth position calculator configured to calculate a position of teeth of the bucket of the work implement in an available display area of the display device; and a following process unit configured to display the work assistance information to follow movement of the bucket of the work implement in the available display area of the display device, and the work assistance information that follows movement of the bucket is displayed always only at a position above the position of the teeth of the bucket of the work implement as calculated by the bucket teeth position calculator, and no work assistance information that follows movement of the bucket is displayed at a position below the position of the teeth of the bucket of the work implement.

2. The work vehicle according to claim 1, wherein the following process unit is further configured to exclude display of the work assistance information that follows movement of the bucket in an area allowing the bucket to move therein, the area allowing the bucket to move therein at a position surrounding the position of the teeth of the bucket of the work implement as calculated by the bucket teeth position calculator.

3. The work vehicle according to claim 2, further comprising:

a fixing process unit configured to display the work assistance information, without following the movement of the bucket, in the available display area of the display device excluding the area allowing the bucket to move therein.

4. A work vehicle comprising:

a work implement having a bucket;

a main body to which the work implement is attached, and having a cab;

a display device provided in the cab and configured to overlay and display first work assistance information following a movement of the bucket and second work assistance information without following the movement of the bucket; and a bucket teeth position calculator configured to calculate a position of teeth of the bucket of the work implement in an available display area of the display device, the display device being configured to avoid displaying the first work assistance information and the second work assistance information in an area between the position of the teeth of the bucket as calculated by the bucket teeth position calculator and a first predetermined level from a lowermost end of the available display area of the display device.

5. A work vehicle comprising:

a work implement having a bucket;

a main body to which the work implement is attached, and having a cab; and a display device provided in the cab and configured to be capable of transmitting external light incident on the cab and display an image;

a bucket teeth position calculator configured to calculate a position of teeth of the bucket of the work implement in an available display area of the display device; and an area setter configured to set as a display area a first area of the available display area of the display device between an uppermost end thereof and the position of the teeth of the bucket as calculated by the bucket teeth position calculator and a second area of the available display area of the display device between a position of a lowermost end thereof and a first predetermined level from the lowermost end.

6. The work vehicle according to claim 5, wherein the area setter determines whether the position of the teeth of the bucket of the work implement as calculated by the bucket teeth position calculator is located in the available display area of the display device at a level higher than a second predetermined level from the position of the lowermost end of the available display area of the display device, the second predetermined level being higher than the first predetermined level, and when the area setter determines that the position of the teeth of the bucket of the work implement as calculated by the bucket teeth position calculator is located in the available display area of the display device at a level higher than the second predetermined level from the position of the lowermost end of the available display area of the display device, the area setter sets as a display area a third area of the available display area of the display device between the uppermost end thereof and the second predetermined level and an area of the available display area of the display device between the position of the lowermost end thereof and the first predetermined level.

7. The work vehicle according to claim 5, further comprising a bucket area calculator configured to calculate a ratio of the available display area of the display device occupied by the bucket of the work implement, wherein the area setter determines whether a result of a calculation by the bucket area calculator is larger than a predetermined value, and if the ratio of the available display area of the display device occupied by the bucket of the work implement is larger than the predetermined value, the area setter sets as a display area an area of the available display area of the display device between the uppermost end thereof and the position of the teeth of the bucket as calculated by the bucket teeth position calculator and a third area of the available display area of the display device between the position of the lowermost end of the display device and the first predetermined level from the lowermost end, whereas if the ratio of the available display area of the display device occupied by the bucket of the work implement is equal to or smaller than the predetermined value, the area setter sets the available display area of the display device entirely as the display area.

8. The work vehicle according to claim 5, wherein the area setter determines whether a distance between the bucket and the cab is smaller than a predetermined distance, and if the area setter determines that the distance between the bucket and the cab is smaller than the predetermined distance, the area setter sets as a display area the first area of the available display area of the display device between the uppermost end thereof and the position of the teeth of the bucket as calculated by the bucket teeth position calculator and the second area of the available display area of the display device between the position of the lowermost end of the display device and the first predetermined level from the lowermost end, whereas if the area setter determines that the distance between the bucket and the cab is equal to or larger than the predetermined distance, the area setter sets the available display area of the display device entirely as the display area.

9. The work vehicle according to claim 5, wherein the area setter sets as a display area the first area of the available display area of the display device between the uppermost end thereof and the position of the teeth of the bucket as calculated by the bucket teeth position calculator and the second area between the position of the lowermost end thereof and the first predetermined level from the lowermost end, excluding an area allowing the bucket to move therein.

10. A method for controlling a work vehicle provided with: a work implement having a bucket; a main body to which the work implement is attached, and having a cab; and a display device provided in the cab and configured to overlay and thus display work assistance information on an actual view of a work site, the method comprising the steps of:

calculating a position of teeth of the bucket of the work implement in an available display area of the display device; and displaying the work assistance information to follow movement of the bucket of the work implement in the available display area of the display device always only at a position above the calculated position of the teeth of the bucket of the work implement, wherein no work assistance information that follows movement of the bucket is displayed a position below the calculated position of the teeth of the bucket of the work implement.

11. A method for controlling a work vehicle provided with: a work implement having a bucket; a main body to which the work implement is attached, and having a cab; and a display device provided in the cab and configured to be capable of transmitting external light incident on the cab and display an image, the method comprising the steps of:

calculating a position of teeth of the bucket of the work implement in an available display area of the display device; and setting as a display area a first area of the available display area of the display device between an uppermost end thereof and the calculated position of the teeth of the bucket and a second area of the available display area of the display device between a position of a lowermost end thereof and a first predetermined level from the lowermost end.

* * * * *